US006109250A

United States Patent [19]

H äberlein et al.

[11] Patent Number: 6,109,250

[45] Date of Patent: Aug. 29, 2000

[54] INTERNAL COMBUSTION ENGINE

[75] Inventors: Jürgen Häberlein, Murrhardt; Georg Becker, Schwaikheim; Maximilian Eberhardt, Esslingen, all of Germany

[73] Assignee: Andreas Stihl AG & Co., Germany

[21] Appl. No.: 09/321,669

[22] Filed: May 28, 1999

[30] Foreign Application Priority Data

May 29, 1998 [DE] Germany ..... 198 24 041

[51] Int. Cl.[7] ..... F01M 13/04

[52] U.S. Cl. ..... 123/572

[58] Field of Search ..... 123/572, 573, 123/574, 41.86

[56] References Cited

U.S. PATENT DOCUMENTS

| | | | |
|---|---|---|---|
| 3,834,156 | 9/1974 | Cutler et al. | 123/572 |
| 4,651,704 | 3/1987 | Sekiguchi | 123/572 |
| 4,922,881 | 5/1990 | Tamba et al. | 123/572 |
| 5,947,068 | 9/1999 | Araki | 123/572 |

*Primary Examiner*—Marguerite McMahon
*Attorney, Agent, or Firm*—Robert W. Becker & Associates

[57] ABSTRACT

An internal combustion engine has a reciprocating piston moving in a cylinder. A crank shaft is mounted in the interior of the crankcase. A connecting rod connects the piston to the crankshaft. The crankcase has a venting device for pressure compensation of the interior of the crankcase. The venting device has a venting line having a channel extending in a rotary component of the engine.

23 Claims, 6 Drawing Sheets

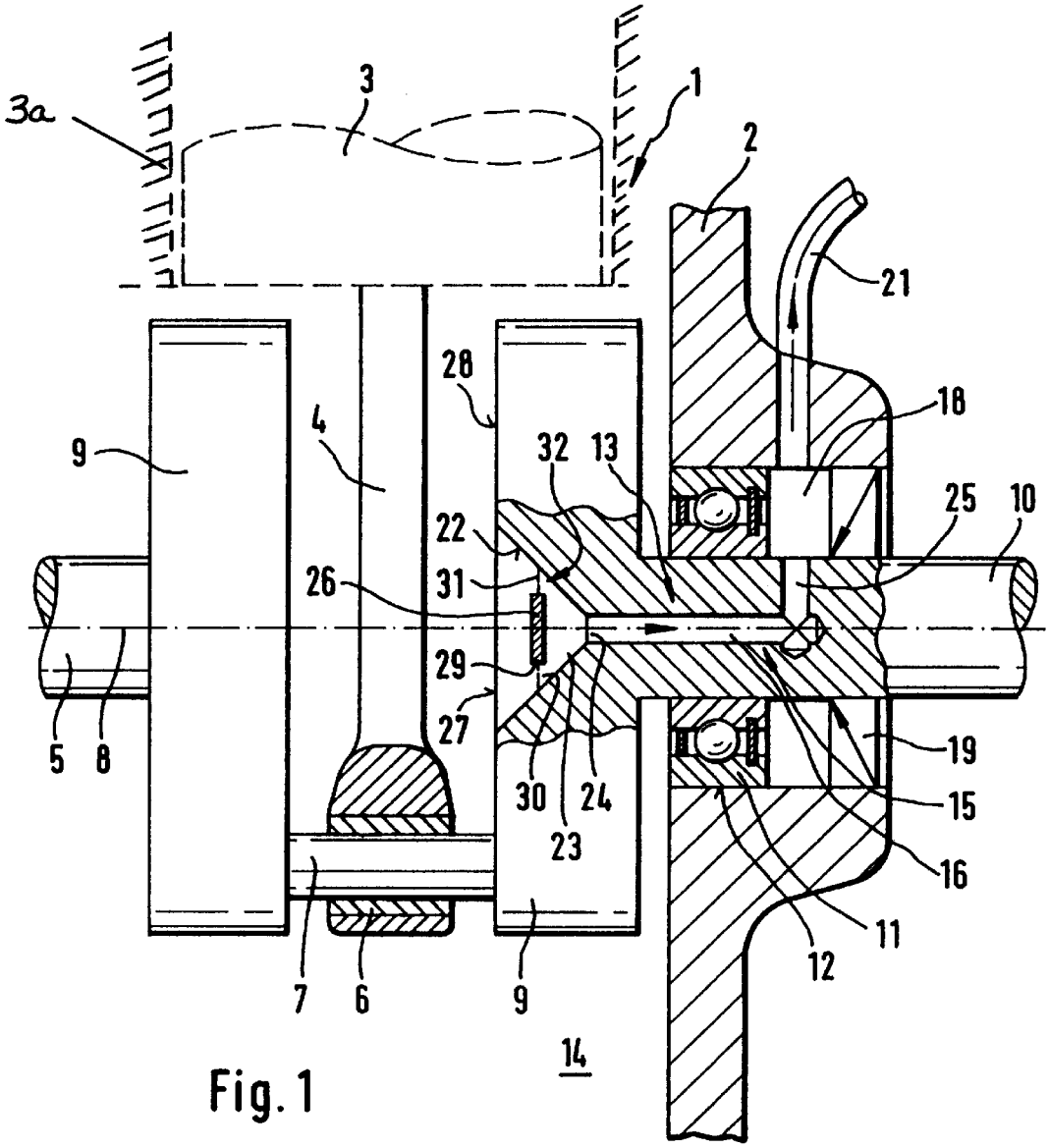
Fig. 1
Fig. 2
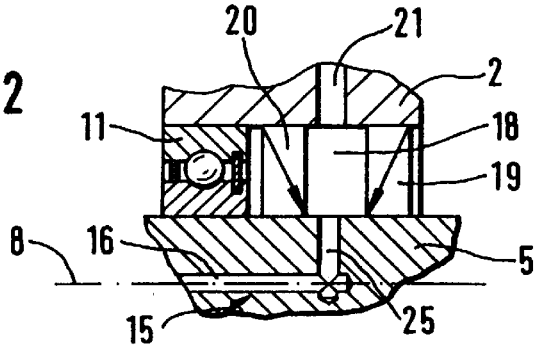

INTERNAL COMBUSTION ENGINE

BACKGROUND OF THE INVENTION

The present invention relates to an internal combustion engine having a reciprocating piston which is connected by a connecting rod to a crankshaft for driving further rotary components of the motor. The crankshaft is supported in a crankcase that is provided with a venting device for pressure compensation in the interior of the crankcase, whereby the venting device has a venting line extending outwardly from the interior of the crankcase.

In such internal combustion engines, especially four-stroke engines or engines of similar construction having a separate lubrication system, it must be ensured for proper functioning that over the course of time no impermissibly high pressure will be built in on the interior of the crankcase. It is thus known to provide the crankcase with a compensation system by which the excess pressure within the crankcase can be released to the atmosphere. However, since in the crankcase oil mist is present, it must be ensured that oil will not be dispensed uncontrollably into the atmosphere but is contained within the crankcase. Accordingly, complicated separating devices must be provided which, however, do not reliably ensure proper separation.

It is therefore an object of the present invention to provide a crankcase venting device for internal combustion engines, especially four-stroke internal combustion engines, which ensures a high degree of separation (retention of oil) while at the same time ensures proper venting of the crankcase.

SUMMARY OF THE INVENTION

Since according to the present invention, the venting line is provided within a rotary component of the motor and this venting line provides the direct connection between the interior of the crankcase and a chamber, the flow-conducting channels are thus subjected to rotation. The resulting centrifugal forces can be used to separate oil and fuel vapors from the air. For the conventional operating rpm of the internal combustion engine, for example, a range of 2,000 to 15,000 rpm, a safe and reliable separation is ensured.

The venting line is preferably a central bore in the rotary component or can be provided as an axial groove in the mantle surface of the shaft on which the rotary component is mounted.

In both cases the inlet, provided within the interior of the crankcase and connected to the venting line, may be covered by an air-permeable material whereby the fine oil mist that is entrained in the venting air will be separated from the air flow within the material of the fabric, non-woven etc. in the form of small droplets and is then mechanically precipitated by centrifugal forces resulting from the rotation of the component and returned into the crankcase. For increasing the separation effect, the venting line can have a widened portion, i.e., a portion having a larger diameter, which can be embodied as a cone. Expediently, within the cone a rebound plate or a truncated cone structure, widening in the direction of the venting line, may be positioned, both having an edge which, together with the inner wall of the cone, provides a narrow annular gap. Within the narrow annular gap the air-permeable material may be positioned, which is preferably a textile or metal fabric, so that the air exiting the interior of the crankcase will pass through the fabric and the entrained oil droplets will then be retained within the fabric, whereby small droplets will convert into bigger ones in the air-permeable material and separated by centrifugal force caused by rotation. The oil droplets flow along the wall of the inlet portion or the cone back into the interior of the crankcase. The oil precipitated in the air-permeable material positioned at the inlet is thus constantly removed so that the fabric cannot become plugged.

BRIEF DESCRIPTION OF THE DRAWINGS

The object and advantages of the present invention will appear more clearly from the following specification and conjunction with the accompanying drawings, in which:

FIG. 1 shows a part-sectional view of the crankcase of an internal combustion engine;

FIG. 2 shows a part-sectional view of the bearing embodiment with two sealing rings;

DESCRIPTION OF PREFERRED EMBODIMENTS

The present invention will now be described in detail with the aid of several specific embodiments utilizing FIG. 1 through 14.

Figure 3:
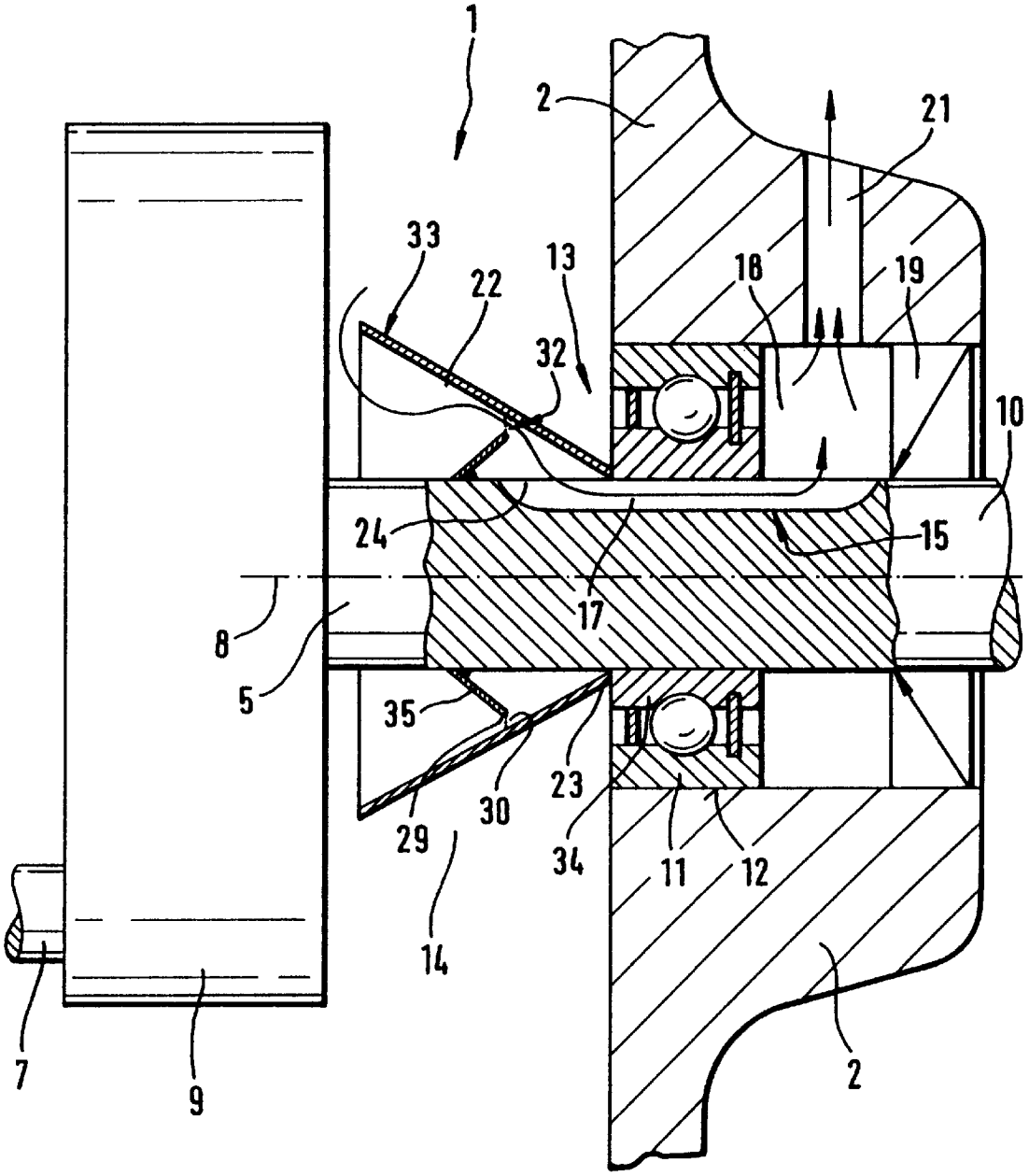
FIG. 3 shows a part-sectional view of the crankcase in a representation according to FIG. 1.

The crankcase 2 represented in FIG. 1 is a component of known internal combustion engine 1 with a piston 3 that reciprocates within a cylinder 3*a*. The piston 3 is connected by a connecting rod 4 to a crankshaft 5 that is driven in rotation by the piston 3. The connecting rod 4 is secured with a connecting rod bearing 6 on the crank bolt 7 which is secured eccentrically to the longitudinal axis 8 of the crankshaft 5 between two crank arms 9. The crankshaft 5 is secured at its ends 10 in crankshaft bearings 11 which are inserted into bearing housings 12 of the crankcase 2. The crankcase bearings 11 in the shown embodiment are roller bearings. In FIGS. 1 and 3, only one end 10 of the crankshaft 5 supported in the crankshaft bearing 11 is represented.

For pressure compensation within the crankcase 2, a crankcase venting device 13 is provided which has a venting line 15 extending from the interior 14 of the crankcase 2 to the exterior of the engine. The venting line 15 is provided in the form of a channel 16, 17 in a rotary component of the engine, in the shown embodiment in the crankshaft 5, whereby the channel 16, 17 provides a connection between the interior 14 of the crankcase 2 and a chamber 18 which is vented into the atmosphere, preferably into the air intake system of the combustion engine 1.

The chamber 18 is expediently formed between the crankshaft bearing 11 and an outer crankshaft seal 19 whereby the crankshaft bearing 11 delimits the chamber 18 relative to the crankcase interior 14 and the crankshaft seal 19 provides an oil and gas tight sealing action in the outward direction. The chamber 18 is penetrated by the crankshaft 5 and is thus in the form of an annular chamber. In order to provide a sealing action between the chamber 18 and the crankcase interior 14, the crankshaft bearing 11 is embodied as a sealed bearing. It may be expedient to provide between the crankshaft bearing 11 and the chamber 18 a further crankshaft seal 20, as is shown in FIG. 2.

The chamber 18 is connected with an outwardly extending line 21 which opens into the intake manifold of the engine or into the atmosphere at a suitable location.

In the embodiment according to FIG. 1, the channel of the venting line 15 is preferably embodied as a central bore in the crankshaft 5, i.e., in the inner portion of the end 10 facing the interior 14 of the crankcase 2. As shown in FIG. 1, at the end face 28 of the crank arm 9 facing the connecting rod 4, a widened inlet portion in the form of a cone 22 is provided which is positioned radial-symmetrically to the longitudinal center axis of the crankshaft 5 and whose tapered end 23 is connected to the venting line 15. The central bore 16 extends to a radial transverse bore 25 which provides communication between the central channel or bore 16 and the chamber 18. The transverse bore 25, can be embodied as a blind bore, as is shown, or as a through bore. The central bore 16 is provided as a blind bore beginning at cone 22.

A rebound plate 26 is arranged within the cone 22 and extends perpendicularly to the inlet 24 at a spacing to the inlet opening. The rebound plate 26 is positioned radial-symmetrically to the longitudinal axis 8 of the crankshaft 5 and delimits with its outer edge 29 an annular gap 30 which is defined by the wall of the cone 22 and the edge 29 of the rebound plate 26. The rebound plate 26 is connected by stays, preferably, a ring element 31, to the cone 22 whereby the ring element expediently is embodied of air-permeable material 32, especially a textile or metal fabric. It may be expedient to embody the rebound plate 26 also of an air-permeable material 32, i.e., a fabric.

The embodiment according to FIG. 3 corresponds substantially to FIG. 1 so that identical parts are referenced with the same reference numerals. The venting line 15 is an axial groove 17 in the outer mantle of the crankshaft 5, whereby the axial groove 17 extends from the interior 14 of the crankcase 2 into the chamber 18. Between the crankshaft bearing 11 and the crank arm 9, a cone 33 consisting of sheet metal, plastic, or other stiff materials is arranged on the inner portion of the antenna of the crankshaft 5. The cone 33 widens in a direction toward the crank arm 9 and forms an outlet funnel similar to cone 22. The cone 33 embraces with its tapered end 23 the inner end of the axial groove 17 which provides the inlet for the venting line 15. The tapered end 23 sealingly connects to the inner ring 34 of the crankshaft bearing 11 so that pressure compensation will take place exclusively via the cone 33 (outlet funnel 22). A truncated cone 35 is fastened within the outlet funnel 22 on the crankshaft 5 whereby the truncated cone 35 widens in the direction toward the tapered end 23 of the funnel structure 22. Between the edge 29 of the truncated cone 35 and the wall of the cone 33, an annular gap 30 is formed through which the crankcase gases can flow into the venting line 15, respectively, the axial groove 17 and from there into the chamber 18. In the embodiment according to FIG. 3, the opening of the venting line 15 can be covered by an air-permeable material 32, for example, a fine mesh textile or metal fabric, non-woven etc. whereby the material or fabric can be attached directly or indirectly to the crankshaft. This ensures that the material 32 or the fabric rotates with the crankshaft so that sufficient centrifugal forces will act on oil retained in the material for precipitation therefrom. The separation effect which is realized simply by providing a centrifugal force, is further improved by the fabric also being rotated so that venting of the air from the crankcase directly into the atmosphere is possible.

Figure 4:
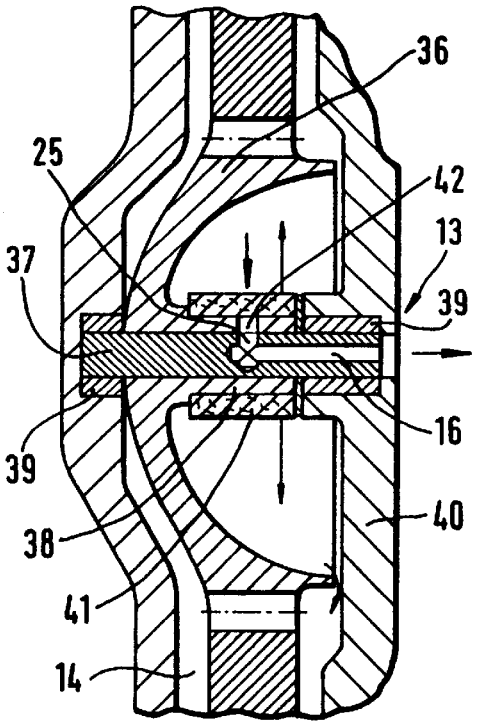
FIG. 4 shows a section of a portion of a valve drive with venting lines.

In the embodiment according to FIG. 4, another rotating component, in particular, a gear wheel 36, is provided which is preferably a part of the valve drive of the four-stroke engine and this rotary component is used for embodying the venting device 13. The gear wheel 36 is fixedly attached to the shaft 37 which is arranged in the bearing 39 in the housing 40 of the internal combustion engine. The gear wheel 36 has a sleeve portion 38 which embraces the shaft 37 and supports a sleeve 41 comprised of fabric, non-woven etc. The sleeve portion 38 has a radial bore 42 aligned with the transverse bore 25 and opening into the central blind bore 16 of the shaft 37. The central bore 16 is a blind bore extending from the axial end face of the shaft 37 which is positioned in the bearing recess open to the atmosphere. The valve drive thus communicates directly with the interior 14 of the crankcase. When high pressure is present, air can flow via the sleeve 41, the radial bore 42, the transverse bore 25, and the bore 16 to the atmosphere. The fine oil mist, which is entrained in the air, is retained in the fabric of the fabric sleeve 41 and will form larger oil droplets which are then radially removed by rotation of the sleeve 41 due to centrifugal forces. The sleeve 41 is fixedly attached to the sleeve portion 38 and rotates thus at the same rpm as the gear wheel 36. The gear wheel 36, in order to avoid a liquid oil slump on the sleeve 41, is of a cup-shaped design, as is shown in FIG. 4. Oil droplets which fly off the sleeve 41, will reach the cup wall, then flow along the cup wall and over the edge back into its crankcase 2.

Figure 5:
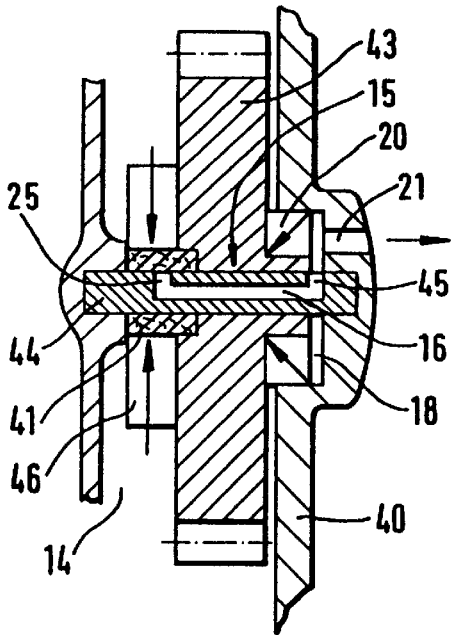
FIG. 5 shows in sections schematically a gear wheel which is mounted on a pin comprising a venting line.

In the embodiment according to FIG. 5, a gear wheel 43 is shown which is driven in rotation by the crankshaft. The gear wheel 43 is mounted on a pin 44 secured in the housing. The gear wheel 43 rotates on the pin 44 having a central bore 16 extending therethrough. It communicates at its ends with the axial transverse bores 25, 45. The transverse bore 25 facing the interior 14 of the crankcase is positioned axially upstream of the gear wheel 43 and is covered by a sleeve 41 which rotates on the pin and is fixedly secured to the gear wheel 43. At the other end of the central bore 16, the transverse bore 45 provides a connection to the chamber 18 which is formed between the housing 40 and the gear wheel 43 by providing a corresponding shaft seal 20. The chamber 18 is connected by a line 21 to the atmosphere or the air intake system of the internal combustion engine.

The end face of the gear wheel 43 facing away from the chamber 18 is advantageously provided with radial vanes 46 which accelerate the oil mist in the centrifugal direction. This further improves the oil separation from the air flow into the atmosphere and will make it possible to eliminate, depending on the resulting degree of separation, the arrangement of a fabric or non-woven sleeve 41. In the embodiment according to FIG. 5, for the purpose of increasing the separation effect, a sleeve 41 is provided adjacent to the separation surfaces along the path to the venting line so that an optimal high degree of separation of the entrained oil can be achieved which allows venting of the chamber 18 directly into the atmosphere.

In the embodiment according to FIG. 5, the sleeve 41 is radially supported by the vanes 46. Accordingly, even at high rpm the lifting of the sleeve 41 from the pin 44 is prevented.

Figure 6:
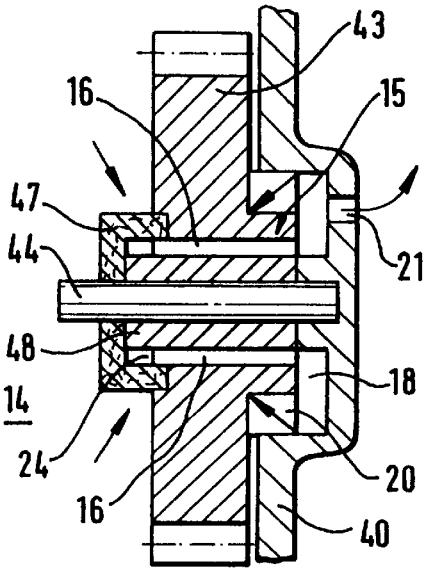
FIG. 6 shows in sections schematically a gear wheel supported on a pin having a venting line.

In the embodiment according to FIG. 6, the venting line is in the form of a plurality of axial bores 16 in the vicinity of the center of the gear wheel 43. The inlets 24 of the bores 16 are covered by a cap 47 facing the interior 14 of the crankcase, whereby the cap 47 is fixedly connected to the gear wheel 43 and is comprised of an air-permeable material, fabric, sieve, fleece, etc. The gear wheel 43 has an extended bearing portion 48 which projects past the inlets 24 in the axial direction and rests at the bottom of the cap 47.

Figure 7:
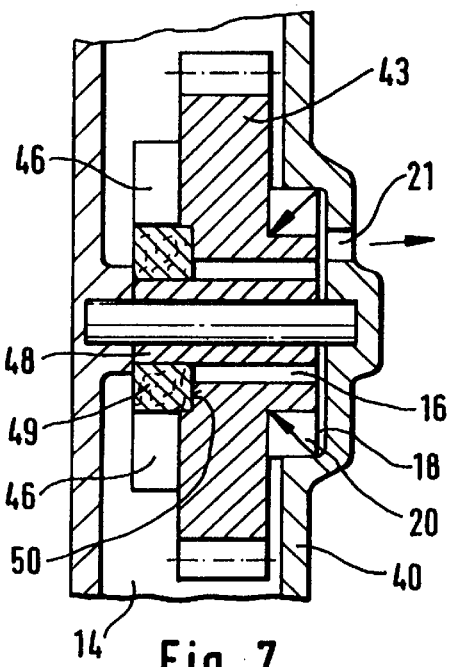
FIG. 7 shows in section a representation according to FIG. 6 of an another embodiment.

The embodiment according to FIG. 7 corresponds to the embodiment of FIG. 6. However, instead of the cap 47 a ring 49 is provided which is fixedly connected to the bearing portion 48 of the gear wheel 43 and is preferably inserted into the axial depression 50 of the gear wheel 43. The bores 16 of the venting line 15 open into the depression 50 and are thus covered axially by the ring 49 comprised of filter fabric, filter fleece or a similar material. It may be expedient to arrange according to the embodiment of FIG. 5 on the end face of the gear wheel 43 facing the chamber 18 radial vanes 46 which support the filter ring 49 radially and function as mechanical precipitators where the oil mist will be precipitated and removed due to the rotation of the gear wheel 43.

Figure 8:
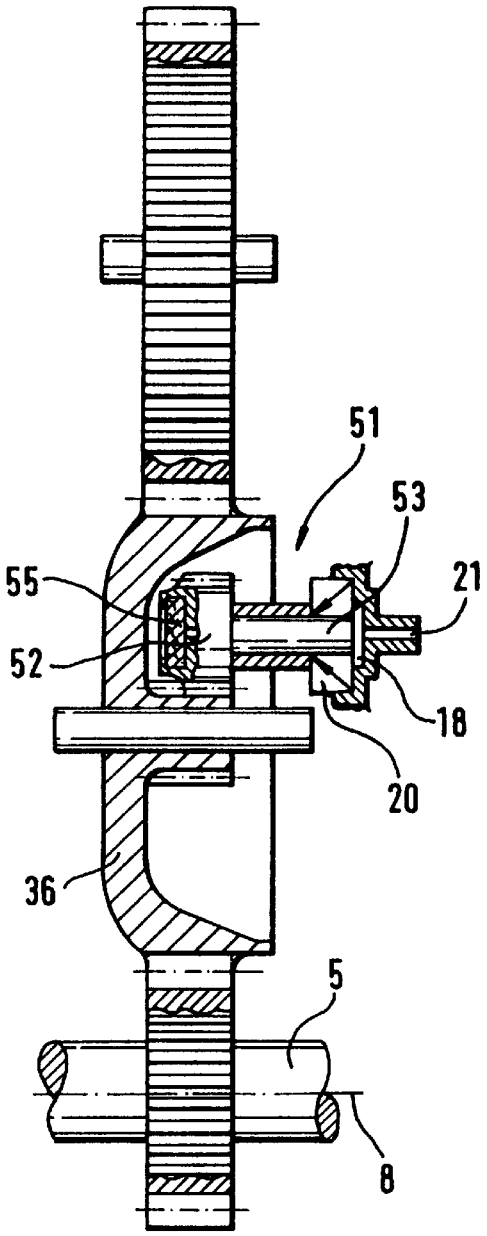
FIG. 8 shows in section an additional rotary component that comprises a venting line.
Figure 9:
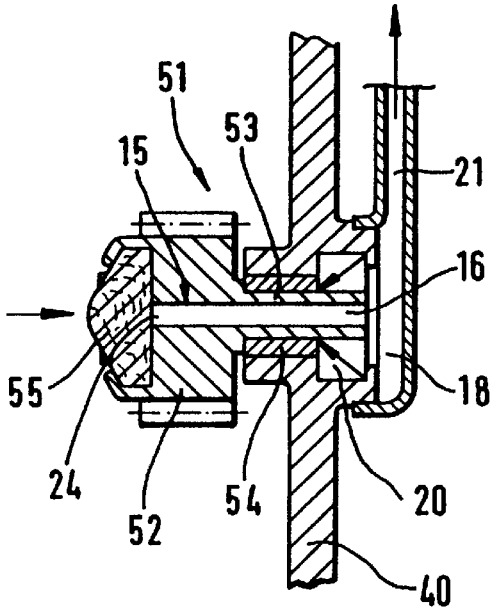
FIG. 9 shows an enlarged representation the venting component according to FIG. 8.

In the embodiment according to FIG. 8, the crankcase venting device is provided in a different component of the internal combustion engine in a separate venting component 51 which is driven by a corresponding drive device, in the embodiment a gear wheel pair, by the crankshaft of the internal combustion engine. In FIG. 9, the venting component 51 is shown in an enlarged representation. It is comprised substantially of a gear wheel 52 with an axial bearing portion 53 in the form of a short shaft that is positioned in a matching bearing 54 of the housing 40. The venting line 15 is a throughbore in the gear wheel 52 and the short shaft 53. The inlet 24 of the venting line 15 is covered by a filter fleece 55 which rotates together with the gear wheel 52. The venting line 15 opens into the chamber 18 which is positioned between the housing 40 and an expediently placed cap and is connected by a line 21 to the atmosphere.

The advantage of a separate venting component 51 is that it can be designed freely according to constructive specifications for any suitable location within the internal combustion engine.

Figure 10:
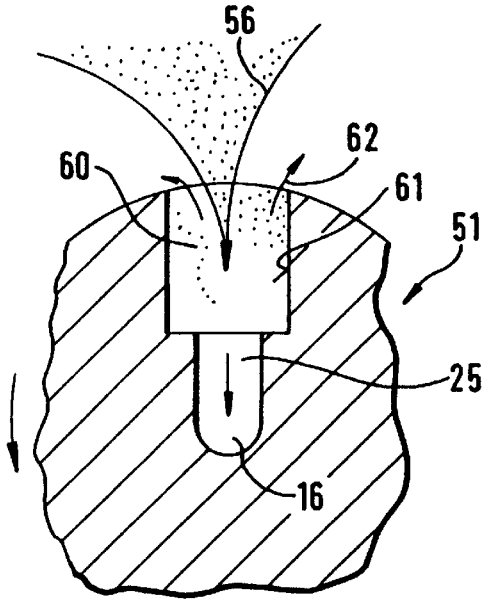
FIG. 10 shows in section schematically a venting line with a radial and an axial line portion.
Figure 11:
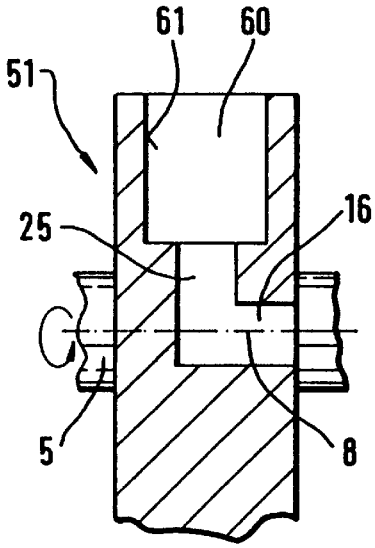
FIG. 11 shows a section along the line XI—XI of FIG. 9.

The embodiment according to FIGS. 10 and 11 shows schematically a further design of a crankcase venting device in which a venting component 51 rotates with a shaft, for example, the crankshaft 5. The transverse bore 25 extending radially to the central bore 16 has a widened inlet portion 60 having an inner wall 61 at which the oil mist entrained in the air flow will precipitate and will be removed by centrifugal force due to the rotation in the direction of arrow 62 to be returned into the crankcase. The air removed via the central bore 16 is thus substantially free of oil particles.

Figure 12:
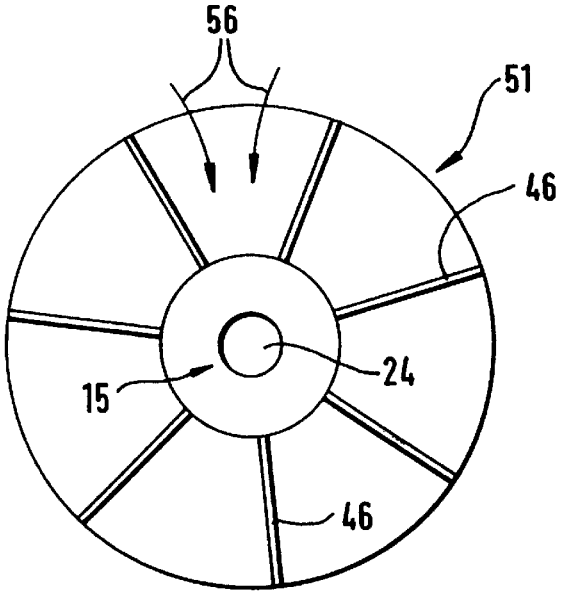
FIG. 12 shows a view of a fan wheel with central bore as a venting line.
Figure 13:
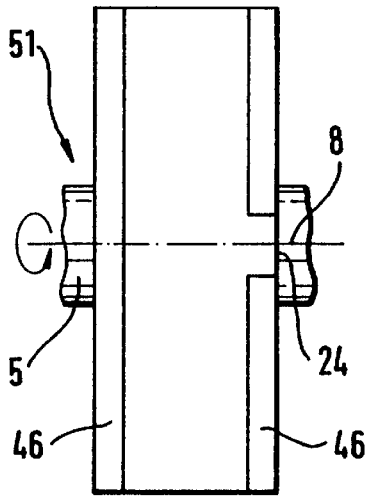
FIG. 13 shows a side view of the fan wheel of FIG. 12.

In the embodiment according to FIGS. 12 and 13, the separation is realized by radial vanes 46 which are arranged radially to the inlet 24 into the venting line 15. The oil mist which is entrained in the air flow 56 into the inlet 24 of the venting line 15 is accelerated centrifugally by the vanes 46 and is radially returned into the crankcase.

It should be noted that the separation effect is primarily the result of the centrifugal force acting on the liquid components of the oil mist, as is shown especially in FIGS. 10 through 13. The arrangement of an additional filter sieve, fabric etc. in front of the inlet 24 is therefore not a requirement. The arrangement of such a filter fleece, however, can improve the oil separation to an optimal level.

Figure 14:
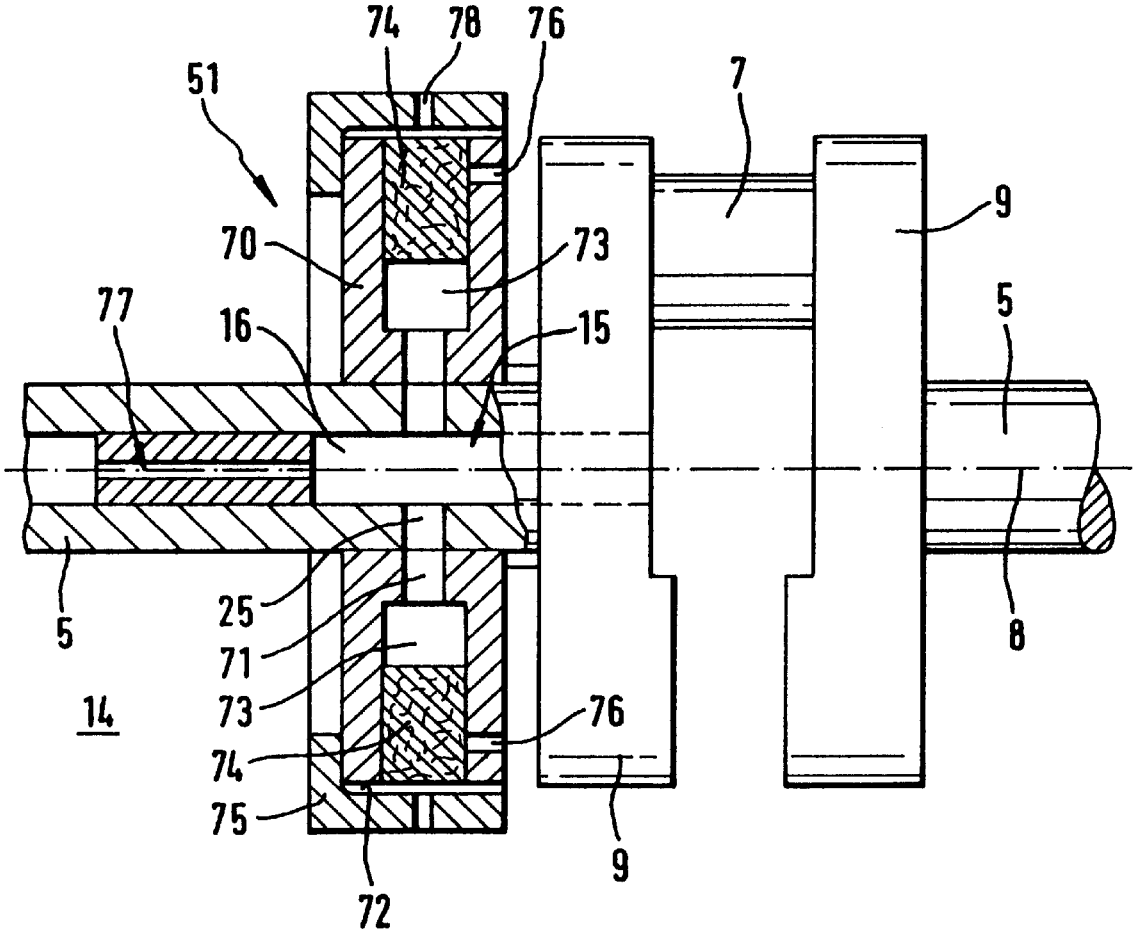
FIG. 14 shows a venting component for the crankcase mounted on the crankshaft.

In the embodiment according to FIG. 14, a crankshaft 5 has mounted thereon a venting component 51 which is comprised substantially of a disc 70 which has radial bores 71 distributed about the circumference 72 of the disc and opening into widened inlet sections 73. In the widened inlet section 73 fabric inserts 74 are positioned which are secured by a collar 75 embracing the disc and thereby radially securing the inserts 74. On the end face facing the crank arms 9, the disc 70 has inlet bores 76 by which the pressure compensation of the crankcase interior 14 is realized via the central venting lines 16. In the bores 16 a throttle 77 is arranged which reduces the bore cross-section to a size that is expedient for venting. It is thus ensured that at the inlet of the crankcase venting device minimal flow velocities are present in order to avoid entrainment of oil droplets into the venting channels. The oil entrained in the air entering the inlet bores 76 will be precipitated in the fabric inserts, fleece inserts etc. within the inlet section 73. Due to the centrifugal force, the oil is then returned via the removal bores 78 arranged in the disc 70 into the crankcase interior 14. The inlet sections 73 open into the bores 71 that have a reduced diameter and are congruent to the transverse bores 25 in the crankcase 5. They provide communication to the central removing bores 16. In the flow direction toward the atmosphere, the throttle 77 is arranged in order to determine a suitable flow cross-section. It should be mentioned that with the basic construction according to FIG. 14 a sufficient separation can be achieved without use of fabric or fleece inserts.

The specification incorporates by reference the disclosure of German priority document 198 24 041.4 of May 29, 1998.

The present invention is, of course, in no way restricted to the specific disclosure of the specification and drawings, but also encompasses any modifications within the scope of the appended claims.

What is claimed is:

1. An internal combustion engine comprising:

a reciprocating piston (3) moving in a cylinder (3*a*);

a crankcase (2) having an interior (14);

a crankshaft (5) mounted in said interior (14) of said crankcase (2);

a connecting rod (4) connecting said piston (3) to said crankshaft (5);

said crankcase (2) having a venting device (13) for pressure compensation within said crankcase (2);

said venting device (13) comprising a venting line (15) having a channel (16, 17) extending in a crankshaft of said engine.

2. An internal combustion engine according to claim 1, wherein said crankcase (2) has a chamber (18) and wherein said channel (16, 17) connects said interior (14) and said chamber (18).

3. An internal combustion engine according to claim 2, wherein said channel (16) is an axial bore in said crankshaft.

4. An internal combustion engine according to claim 3, wherein said axial bore (16) is positioned in proximity to an axis of rotation of said crankshaft (8).

5. An internal combustion engine according to claim 3, wherein said axial bore (16) extends coaxially to said axis of rotation (8).

6. An internal combustion engine according to claim 1, wherein said venting line (15) is an axial groove (17) in a mantle surface of said crankshaft (5).

7. An internal combustion engine according to claim 1, wherein said interior (14) has an inlet (24) connected to said venting line (15) and wherein said inlet (24) is covered by an air-permeable material.

8. An internal combustion engine according to claim 7, wherein said air-permeable material is fastened to said crankshaft (5).

9. An internal combustion engine according to claim 7, wherein said inlet (24) has a widened inlet portion (60).

10. An internal combustion engine according to claim 9, wherein said widened portion (60) is a cone (22) and wherein a tapered end (23) of said cone (22) is connected to said venting line (15).

11. An internal combustion engine according to claim 10, wherein said cone (22) has a center axis and wherein said center axis of said cone (22) coincides with a longitudinal center axis of said crankshaft (5).

12. An internal combustion engine according to claim 10, wherein said cone (22) is located in a crank arm (9) of said crankshaft (5).

13. An internal combustion engine according to claim 10, comprising a rebound plate (26) mounted perpendicularly to said venting line (15) centrally in said cone (22) such that between an edge (29) of said rebound plate (26) and a wall of said cone (22) an annular gap (30) is formed.

14. An internal combustion engine according to claim 13, comprising stays connecting said rebound plate (26) to said cone (22).

15. An internal combustion engine according to claim 13, comprising an air-permeable ring element (31) securing said rebound plate (26) in said cone (22).

16. An internal combustion engine according to claim 15, wherein said ring element (31) is comprised of a fine-mesh fabric (32).

17. An internal combustion engine according to claim 7, comprising a rebound element mounted in front of said inlet (24) in said interior (14), wherein said rebound element is comprised of a non-woven material.

18. An internal combustion engine according to claim 2, wherein said chamber (18) is located between a crankshaft bearing (11) of said crankshaft (5) and an outer seal (19) of said crankcase (2).

19. An internal combustion engine according to claim 18, wherein said chamber (18) is penetrated by said crankshaft (5) and is an annular chamber.

20. An internal combustion engine according to claim 18, wherein said crankcase (2) has an inner seal (20) positioned between said crankshaft bearing (11) and said chamber (18).

21. An internal combustion engine according to claim 1, wherein said engine has an air intake device and wherein said venting line (15) connects to said air intake device.

22. An internal combustion engine according to claim 1, wherein said venting lien (15) opens into the atmosphere.

23. An internal combustion engine according to claim 1, wherein said venting line (15) has radial bores (71, 73, 78) for separation of oil.

* * * * *

UNITED STATES PATENT AND TRADEMARK OFFICE

CERTIFICATE OF CORRECTION

PATENT NO : 6,109,250

DATED : August 29, 2000

INVENTOR(S): Jürgen Häberlein, Georg Becker, Maximilian Eberhardt, and Heiko Rosskamp It is certified that error appears in the above-identified patent and that said Letters Patent are hereby corrected as shown be'ow:

On the Title Page, the following item should read as follows:

[75] Inventors:

Jürgen Häberlein, Murrhardt; Georg Becker, Schwaikheim; Maximilian Eberhardt, Esslingen; Heiko Rosskamp, Ehningen, all of Germany Signed and Sealed this Fifteenth Day of May, 2001

Nicholas P. Godici

*Attest:*

NICHOLAS P. GODICI

*Attesting Officer*

*Acting Director of the United States Patent and Trademark Office*